US005119963A

United States Patent [19]

Heilman

[11] Patent Number: 5,119,963

[45] Date of Patent: * Jun. 9, 1992

[54] MECHANICAL BUTTON AND BUTTON ENHANCEMENT TECHNIQUES

[75] Inventor: Robert J. Heilman, Orland Park, Ill.

[73] Assignee: Continental White Cap, Inc., Downers Grove, Ill.

[ * ] Notice: The portion of the term of this patent subsequent to Jul. 30, 2008 has been disclaimed.

[21] Appl. No.: 545,498

[22] Filed: Jun. 29, 1990

[51] Int. Cl.[5] ..... B65D 55/02

[52] U.S. Cl. ..... 215/230; 215/270; 215/341; 215/342

[58] Field of Search ..... 215/230, 262, 270, 341, 215/342, 203, 216, 227; 220/214, 258, 305, 377

[56] References Cited

U.S. PATENT DOCUMENTS

| | | | |
|---|---|---|---|
| 2,131,774 | 10/1938 | Waring | 220/258 X |
| 3,244,308 | 4/1966 | Esposito, Jr. | 215/270 |
| 3,848,761 | 11/1974 | Libit | 215/216 X |
| 3,974,929 | 8/1976 | Montgomery | 215/216 |
| 4,122,964 | 10/1978 | Morris | 215/270 X |
| 4,479,585 | 10/1984 | Sandhaus | 215/216 X |
| 4,502,605 | 3/1985 | Wloszczyna | 215/203 X |
| 4,736,857 | 4/1988 | Monico, Jr. et al. | 215/230 |
| 4,747,500 | 5/1988 | Gach et al. | 220/377 X |
| 4,793,500 | 12/1988 | Harding | 215/230 |
| 4,793,504 | 12/1988 | Towns et al. | 220/214 X |
| 5,018,632 | 5/1991 | Schmidt | 215/230 |
| 5,035,341 | 7/1991 | Heilman et al. | 215/230 |

*Primary Examiner*—Stephen Marcus
*Assistant Examiner*—Vanessa Caretto
*Attorney, Agent, or Firm*—Lockwood, Alex, FitzGibbon & Cummings

[57] ABSTRACT

This relates to a closure for a container in the form of a closure cap which is provided with a mechanically actuated button. The button is centrally located and is generally in a recessed position. The button is surrounded by a plurality of dished areas which, when the closure is applied, will engage the end sealing surface of a container and cause a deflection of the dished areas which will result in an annular portion of the closure surrounding the button to invert and to project the button axially upwardly from its original recessed position to a projecting position. The closure may be enhanced by other tamper indicating arrangements which are sealed to the closure by way of a translucent panel overlying the end panel of the closure and being bonded at its periphery to the closure. The translucent panel will be provided with a layer of material generally axially aligned with the button and the button will be provided with a layer of adhesive, preferably contact adhesive. The layer of material carried by the translucent panel may be formed of a frangible material or may be removed from the translucent panel either to remove a message or to make a message visible.

20 Claims, 1 Drawing Sheet

FIG.1
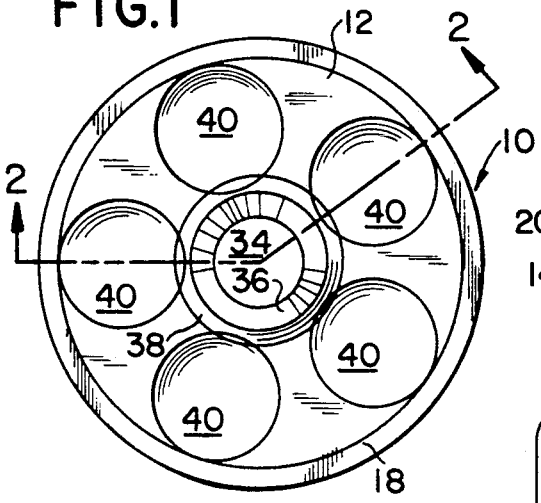
FIG.2
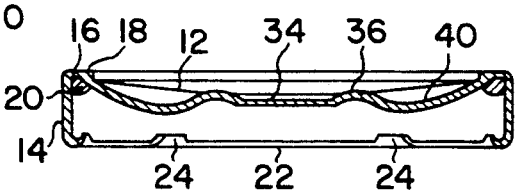
FIG.3
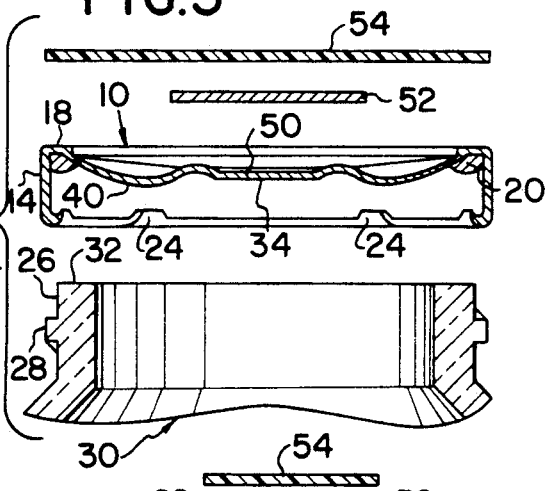
FIG.4
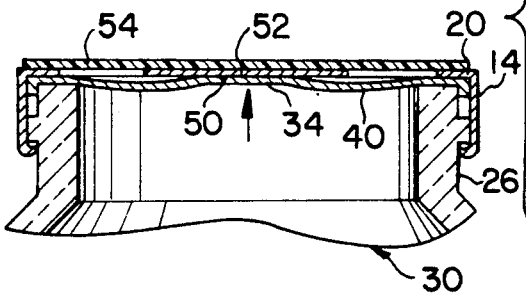
FIG.8
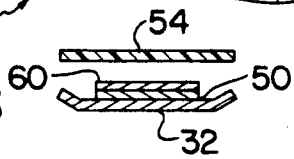
FIG.5
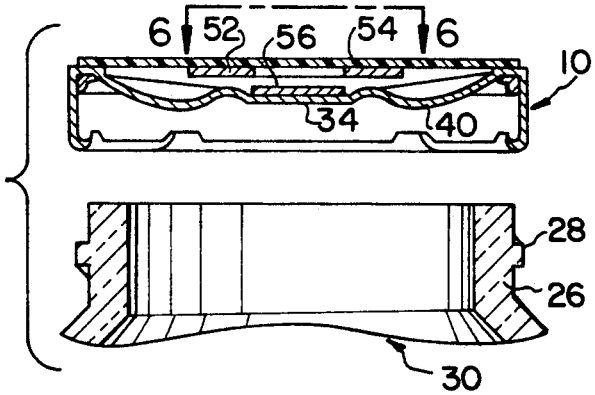
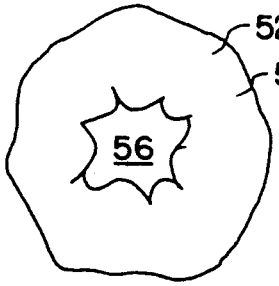
FIG.6
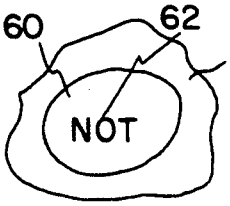
FIG.7

MECHANICAL BUTTON AND BUTTON ENHANCEMENT TECHNIQUES

This invention relates in general to new and useful improvements in closures having buttons for indicating the sealed condition of containers.

BACKGROUND OF THE INVENTION

In the past there has been developed closures which include a central button for indicating the sealed condition of a container. Such buttons are normally upwardly disposed and are drawn down by a vacuum formed within an associated container. When the vacuum is released within the container, the button pops up to indicate the loss of vacuum. While such buttons do indicate the loss of the vacuum within the container, the button does not provide ample indication of the loss of the vacuum and oftentime the change in the state of the button is not observed by a user.

BRIEF DESCRIPTION OF INVENTION

This invention relates in general most specifically to a mechanically actuated button which forms part of a closure. The closure is provided with mechanical means surrounding the button which engage a pouring lip or end of a container when the closure is applied so as to displace the button from a lowered position to an upwardly projected position. The preferred form of the mechanical means is in the form of a plurality of dished areas surrounding the button with the dished areas being engageable with the end of a container so as to deform the dished areas thereby effecting a displacement of the button from its normal lower position to a displaced upper position.

Although the position of the button per se is an indication of whether or not the closure is tightly applied to the container, and thus the displacement of the button may be utilized as means for indicating the relationship of the closure with respect to a container, it does not indicate that the closure has been applied, loosened and reapplied.

Accordingly, further in accordance with this invention there is associated with the closure tamper indicating means which are associated with the button and wherein once the button has been mechanically moved to its outwardly projected position, when the closure is loosened relative to an associated container, the tamper indicating means will be so operated on so as to indicate releasing of the closure with the tamper indicating means not being resetable even if the closure is again tightened.

With the above and other objects in view that will hereinafter appear, the nature of the invention will be more clearly understood by reference to the following detailed description, the appended claims, and the several views illustrated in the accompanying drawings.

FIG. 1 is a top plan view of a closure incorporating the mechanically actuated button of this invention.

FIG. 2 is a transverse vertical sectional view taken generally along the line 2—2 of FIG. 1 and shows the specific details of the closure including the mechanically actuated button.

FIG. 3 is an exploded perspective view of the closure of FIGS. 1 and 2 together with tamper indicating means and a container with which it is to be associated.

FIG. 4 is a vertical sectional view taken through the closure with the tamper indicating means applied thereto and the closure applied to a container.

FIG. 5 is a sectional view showing the closure removed from the container and the tamper indicating means actuated.

FIG. 6 is a fragmentary top plan view of the closure generally along the line 6—6 of FIG. 5 with a clear indication of tampering.

FIG. 7 is a fragmentary plan view of a modified form of closure construction in its applied state and indicating that an associated container has not been opened.

FIG. 8 is a fragmentary vertical sectional view taken through the closure arrangement of FIG. 7 and shows the tamper indicating means as being removed by the button from its associated translucent panel.

Referring now to the drawings in detail, it will be seen that there is illustrated in FIGS. 1 and 2 a closure formed in accordance with this invention. The closure is generally identified by the numeral 10 and is in the form of a cap which is preferably formed of a suitable metal. The cap 10 basically includes an end panel 12 and a depending skirt 14. The end panel 12 is joined to the skirt 14 by a downwardly opening channel 16 having a flat upper surface 18. The channel 16 carries a suitable sealing compound 20.

The skirt 14 terminates in a radially inwardly directed flange 22 which is provided at circumferentially spaced intervals with locking ears 24 of a conventional type.

The closure 10 is intended to be carried by a neck finish 26 of a container 30 with the neck finish 26 including circumferentially spaced lugs 28 in accordance with the number and spacing of the ears 24. The neck finish 26 also includes an end sealing surface 32.

In accordance with this invention, the end panel 12 is of a specific configuration including a central circular button 34 which is defined by a radially outwardly and axially upwardly sloping annulus 36 which, in turn, is surrounded by a generally planar further annulus 38.

Surrounding the button 34 is a plurality of circumferentially spaced dished areas 40 which are generally part hemispherical.

It will be noted from FIG. 1 that each of the dished areas 40 has a radially inner part interrupted by the annulus 38 and a radially outer part interrupted by the surface 18.

It is to be understood that normally the button 34 is in a recessed position as is best shown in FIG. 2. However, when the closure 10 is applied to the container 30, the end sealing surface 32 of the container 30 will upwardly deform a radially outer part of each of the dished areas 40 with the result that the radially outward and upwardly sloping annulus 36 will evert so as to slope downwardly and radially outwardly from the button 34 with the result that the button 34 is elevated. The displacement per se of the button 34 may be relied upon as a mechanical tamper indicating feature to show that the closure 10 has been loosened relative to the container 30.

However, when the closure per se is utilized, one may open the container 30 and then reclose the same with the button 34 moving down to its original position when the container 30 is opened and returning to its upwardly directed position when the container is reclosed so that there can be no evidence of tampering. In accordance with this invention, it is also proposed to enhance the tamper indicating feature of the button 34 as will be described hereinafter.

Referring first to FIG. 3, it will be seen that a layer of material 50 is applied in overlying relation to the button 34 then a lower material 52, which is preferably of a diameter larger than that of the button 34, is provided. Finally, a translucent panel 54 is provided. The layer of material 52 is bonded about its periphery to the underside of the translucent panel 54, after which the translucent panel 54 is suitably bonded to the surface 18.

At this time it is pointed out that the material 50 is preferably in the form of a contact adhesive and that the material 52 is preferably in the form of a frangible material.

When the closure 10, so modified, is applied to the container 30, and the button 34 is deflected upwardly, the adhesive 50 will bond to the underside of the central part of the material 52 as the button 34 presses the adhesive material 50 against the underside of the layer of material 52. The translucent panel 54 will restrict upper axial movement of the material 52.

Then, when the closure 10 is loosened relative to the container 30, as shown in FIG. 5, and the button 34 mechanically snaps downwardly to its original position, that part of the frangible material 52 will rupture and will be torn from the remainder of the material 52 which remains adhered to the translucent panel 54. The ruptured part of the material 52 is identified by the numeral 56.

It is to be understood that even if the closure 10 is reapplied to the container 30, with the result that the ruptured material 56 will go generally back into position within the opening in the material 52 from which it is torn, the rupture of the material 52 will be apparent in the same general manner as shown in FIG. 6 and therefore the evidence of tampering will not be eliminated.

Reference is now made to FIGS. 7 and 8 wherein there is illustrated a slightly modified form of tamper indicating means. In this instance, a layer 60 of a deformable material, such as wax, is provided with a deformed upper surface which, when tightly applied to the underside of the translucent panel 54 will spell out a message 62. The message may simply be in the form of the word "NOT". Thus when the closure 10 is applied to the container 30, the layer 60 will be tightly pressed against the underside of the translucent panel 54 and the message will appear. However, when the closure is moved to an open position, the button 34 will again move downwardly and the adhesive layer 50, previously described, will be bonded to the layer 60 and will draw the layer 60 away from the translucent panel 54 so that the message 62 will disappear.

In yet another form of the invention, a message, such as the word "OPENED" may be printed on the underside of the translucent panel 54 and a layer of material, such as the layer 60 having a color matching the color of the message, will be applied against the underside of the translucent panel 54 so that no message will appear when the closure is applied. However, when the closure is removed and the button retracts, the layer material 60 will be pulled away from the underside of the translucent panel 54 and the message revealed.

It is to be understood that there are many other tamper indicating combinations which may be utilized in conjunction with the button 34 of the specific mechanically actuated closure 10.

Although only several preferred embodiments of the invention have been specifically illustrated and described herein, it is to be understood that minor variations may be made in the construction of the closure 10 and the tamper indicating features utilized in conjunction therewith without departing from the spirit and scope of the invention as defined by the appended claims.

I claim:

1. A closure comprising an end panel, a depending skirt, and means carried by said skirt for securing said closure in sealed relationship to a container, said closure being improved by said end panel being formed with a flexible central tamper indicating button, and said end panel having mechanical means engageable with a container to which said closure is to be applied for flexing said button from a first position occupied when said closure is not sealed to a container to a second position occupied when said closure is sealed to a container.

2. A closure according to claim 1 wherein said mechanical means are in the form of a series of dished areas surrounding said button.

3. A closure according to claim 2 wherein each of said dished areas extends radially generally between said button and said skirt and includes a radially outer portion for direct pressure contact with a container rim.

4. A closure according to claim 2 wherein said end panel terminates in a downwardly opening channel for a sealing compound.

5. A closure according to claim 3 wherein said end panel terminates in a downwardly opening channel for a sealing compound.

6. A closure according to claim 5 wherein said dished areas are radially outwardly foreshortened by said channel.

7. A closure according to claim 2 wherein said dished areas are downwardly recessed.

8. A closure according to claim 2 wherein said dished areas are circular in outline.

9. A closure according to claim 2 wherein said dished areas are downwardly recessed and circular in outline.

10. A closure according to claim 1 wherein said button includes a recessed panel and a flared peripheral part, said flared peripheral part being normally upwardly sloping relative to said recessed panel.

11. A closure according to claim 1 wherein said button includes a recessed panel and a flared peripheral part, said flared peripheral part being normally upwardly sloping relative to said recessed panel, and being deformable to a downwardly sloping position to elevate said recessed panel.

12. A closure according to claim 10 wherein said recessed panel is circular and said peripheral part is annular.

13. A closure according to claim 10 wherein said end panels slope radially inwardly and downwardly towards said peripheral part.

14. A closure according to claim 10 wherein said end panels slope radially inwardly and downwardly towards said peripheral part and there is a generally flattened part surrounding said peripheral part.

15. A closure according to claim 14 wherein said mechanical means are in the form of a series of dished areas surrounding said button and said dished areas extending radially inwardly into said flattened part.

16. A closure according to claim 1 together with a translucent panel overlying said end panel and being peripherally bonded to said end panel with a central portion of said translucent panel being spaced above said button, a tamper iindicating member carried by an underside of said translucent panel in axial alignment with said button, and further means carried by said button and engageable with said tamper indicating member when said closure is applied to a container, said further means being operable to change the condition of said tamper indicating member when said closure is released relative to a container and said button retracts.

17. A closure according to claim 16 wherein said tamper indicating member is readily frangible, and said further means includes means for adhering to at least a part of said tamper indicating member.

18. A closure according to claim 16 wherein said further means includes means for attaching to said tamper indicating member.

19. A closure according to claim 16 wherein said tamper indicating member is applied to said translucent panel in a pattern by means which presents a message when said tamper indicating member is pressed against said translucent panel by said button.

20. A closure according to claim 19 wherein said tamper indicating member is loosely bonded to said translucent panel and said further means includes means for attaching to said tamper indicating member and removing said tamper indicating member from said translucent panel when said closure is released relative to a container and said button retracts.

* * * * *